US006668386B2

(12) United States Patent
Vidal

(10) Patent No.: US 6,668,386 B2
(45) Date of Patent: Dec. 30, 2003

(54) ADJUSTABLE NECK SEAL

(76) Inventor: Naomi Vidal, 23105 - 68 Avenue, Langley, British Columbia (CA), V2Y 2J6

( * ) Notice: Subject to any disclaimer, the term of this patent is extended or adjusted under 35 U.S.C. 154(b) by 38 days.

(21) Appl. No.: 10/122,311

(22) Filed: Apr. 16, 2002

(65) Prior Publication Data

US 2003/0192108 A1 Oct. 16, 2003

(51) Int. Cl.[7] ..... A41D 3/02
(52) U.S. Cl. ..... 2/100; 2/98; 2/128
(58) Field of Search ..... 2/270, 308, 315, 2/321, 331, 158, 336, 323, 324, 329, 486, 84, 85, 86, 87, 88, 91, 92, 93, 94, 96, 98, 99, 100, 171.8, 182.7, 202, 203, 204; 24/442

(56) References Cited

U.S. PATENT DOCUMENTS 2,113,731 A * 4/1938 Kennedy ..... 24/713.2
3,161,890 A * 12/1964 Betz ..... 2/237
4,800,595 A 1/1989 Askew
5,016,290 A 5/1991 Askew
5,136,721 A 8/1992 Farnworth
5,139,187 A * 8/1992 Fowler ..... 224/576
5,263,202 A * 11/1993 Siberell ..... 2/336
5,444,898 A 8/1995 Norvell
5,577,306 A * 11/1996 Gold ..... 24/715.3
5,647,059 A 7/1997 Uglene et al.
5,711,032 A * 1/1998 Carpenter ..... 2/158
5,802,609 A * 9/1998 Garofalo ..... 2/2.17

* cited by examiner

*Primary Examiner*—John J. Calvert
*Assistant Examiner*—Alissa L. Hoey
(74) *Attorney, Agent, or Firm*—C. A. Rowley

(57) ABSTRACT

A sealing system for sealing a garment around an appendage formed by an annular tube surrounding a passage (cuff) through which appendage is intended to protrude and a pull cord extending through said tube for a length to completely encircle said passage over more than 360°. At least one end of the pull cord passes out through a wall of the tube to provide an accessible end for adjusting the length of said cord around said passage and thereby tighten or loosening pressure of tube toward said appendage and form a seal between the tube and the appendage.

20 Claims, 2 Drawing Sheets

ADJUSTABLE NECK SEAL

FIELD OF INVENTION

The present invention relates to a neck seal for a garment, more particularly the present invention relates to a manually adjustable neck seal for a garment such as a dry suit.

BACKGROUND OF THE INVENTION

The use of an adjustable neck seal on garments for closing the neck of a weatherproof and waterproof garment, particularly those worn in adverse conditions and to provide protection in case of accidental immersion in water is known, but the known systems are relatively complicated or expensive.

U.S. Pat. No. 5,016,290 issued May 11, 1991 to Askew discloses a closure system that include a tube that extends in a circle around the appendage against which the closure system is to be closed and a cord or draw string that extends from one side of an opening into the tube, though the tube for less than 360° and out through the other side of the opening. I.e., at least one end of the drawstring extends through the opening to provide a gripping portion to adjust the draw string and the other end is fixed on the one side of the opening. This arrangement provides a length of tubing that is not directly forced against the portion of the appendage opposite or adjacent to the opening through which the cord extends. This arrangement does not form as watertight a system, hence is suited for wet suit application only not a dry suit. The amount of leakage being in part dependent on the circumferential length of the opening. The present invention overcomes this disadvantage.

U.S. Pat. No. 5,647,059 issued Jul. 15, 1997 to Uglene discloses another type of sealing system specifically directed to providing a neck seal. This system is more complex and costly in that it requires inflation; and uses a thick band of compressible foam which is obtrusive to the wearer compared to present invention.

U.S. Pat. No. 5,136,721 issued Aug. 11, 1992 to Farnworth et al. describes yet another form of neck seal. This invention uses a thick band of compressible foam that is obtrusive to the wearer compared to present invention and does not form as watertight a system as present invention.

U.S. Pat. No. 4,800,595 issued Jan. 31, 1989 to Askew discloses a closure system employing a drawline that at one end is fixed to the garment, extends partway around the opening to be closed and then returns to the outside and provides an accessible end that may be manipulated to adjust the tension in the drawline and thereby the pressure against the encircled-appendage. This system has been found not to form a watertight closure as effective as the present invention.

U.S. Pat. No. 5,444,898 issued Aug. 29, 1995 to Norvell uses a slide fastener one stringer of which is folded over to form an internal flap that is positioned behind the other stringer and is intended to block the entry of water that passes through the gaps in the slide fastener and provide a water resistant seal.

BRIEF DESCRIPTION OF THE PRESENT INVENTION

It is an object of the present invention to provide an improved water resistant adjustable closure that may function as a seal around a body appendage, particularly for the formation of a neck seal on a dry suit or the like.

Broadly the present invention relates to a sealing system for providing a water resistant seal around an appendage comprising an annular flexible tube forming part of a garment and surrounding a passage through which said appendage is intended to protrude, a pull cord extending through said tube for a length to completely encircle said passage over more than 360° from one end of said pull cord to an opposite end of said pull cord, said one end passing out of said tube through a wall of said tube to provide an accessible end for adjusting the length of said cord around said passage and thereby adjusting the tension in said cord to increase or reduce pressure of said tube toward said appendage the amount of said pressure effecting the effectiveness of a seal formed between the tube and the appendage and securing means adjacent to said opposite end to secure said cord to prevent relative movement between said cord said adjacent to said opposite end and said tube.

Preferably said appendage is a neck of a wearer and said sealing system is a neck sealing system.

Preferably said tube is made of pliable material that is permeable to water vapor but not liquid water.

Preferably said sealing system further includes a releasable locking means outside of said tube for engaging said cord on said accessible end for releasably preventing relative movement between said cord adjacent to said accessible end and said tube.

Preferably said opposite end extend out of said tube through said wall and said securing means is a releasable locking means for engaging said cord on said opposite end for releasably preventing relative movement between said cord adjacent to said opposite end and said tube so that said opposite end may be adjusted relative to said tube.

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which.

DETAILED DESCRIPTION OF THE INVENTION

Figure 1:
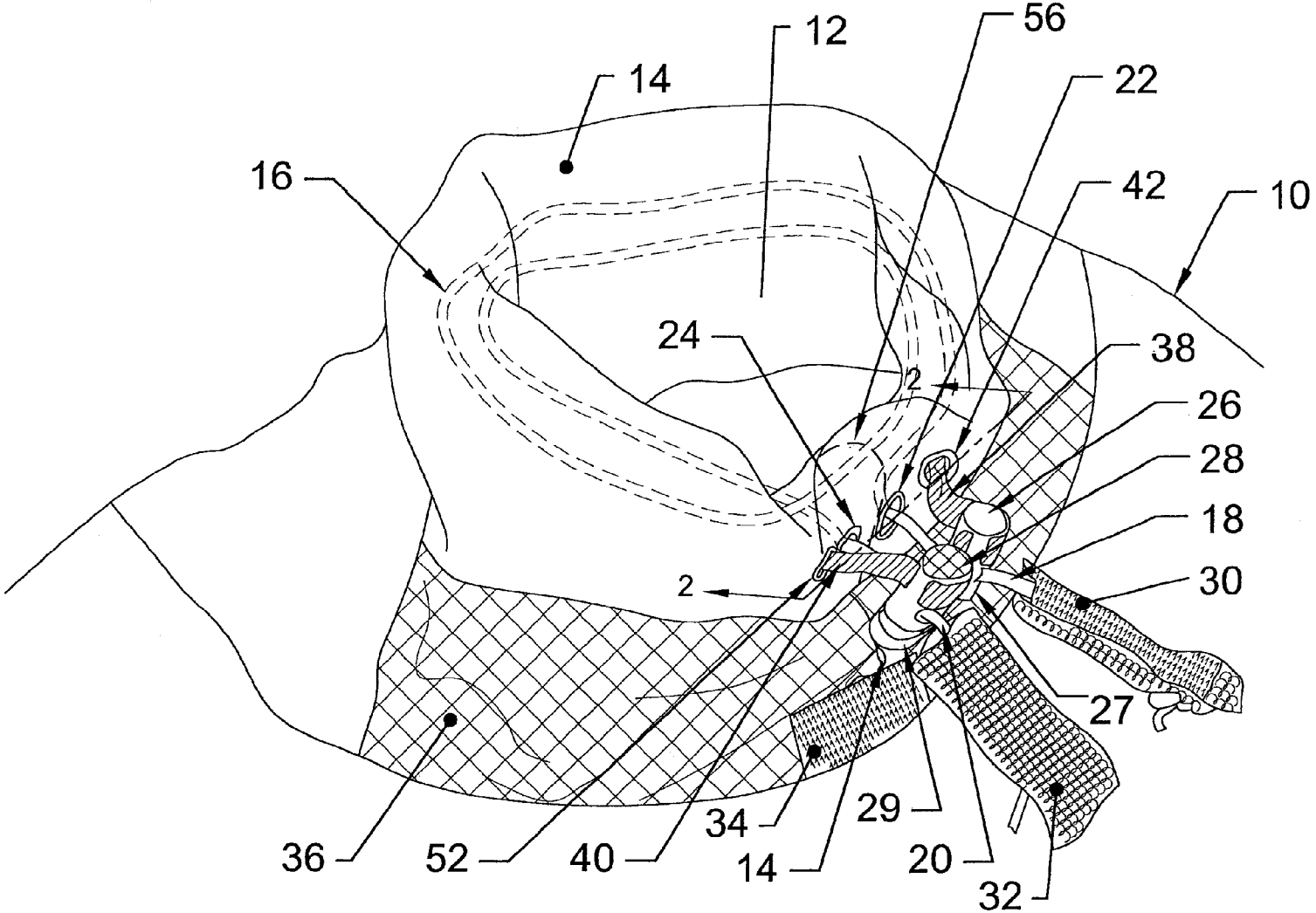
FIG. 1 is an isometric illustration showing the neck of the garment with the pull cord shown in dash lines to illustrate how the cord is positioned around the neck opening with the cord in released condition i.e. the neck seal of the present invention in non-scaling condition. [please revise the figure to show the cord in dash (hidden lines) in the tube forming the collar of the garment.

The Figures show the water resistant closure system of the present invention applied to the neck opening 12 of a garment 10 and accordingly the description will deal primarily with the neck sealing embodiment, but it will be apparent the closure system may be applied to any other suitable opening or cuff structure through which a body appendage may extend and with which the sealing or inclosing tube 14 of the present invention may cooperate to form a seal. For example the invention could also be applied to an arm (sleeve) or leg opening. The main element of the present invention are a flexible tube 14 which completely encircles the opening 12 and the pull cord 16 that is positioned within the tube 14 and extends substantially completely around the opening twice i.e. over 360° and preferably about 720° see FIG. 1.

In the illustrated arrangement each end 18 and 20 of the pull cord 16 that preferably is elastic extend out through the front wall of tube 14 (which forms the collar of the garment) through its suitable grommet 22 and 24 respectively. It is not essential that both ends 18 and 20 extend as illustrated only one end need be made adjustable and the opposite end simply secured in place relative to the tube 14 however by carrying both ends out of the tube and providing each with its own cord lock 26 and 28 respectively as will be described below provide redundancy should one cord lock become defective. Two cord locks allow for tightening and un-tightening with either left or right hands. In the preferred system a 3 mm thick elastic cord forms two loops around wearer's neck.

Referring back to the illustrated embodiment the end 18 extend from the grommet 22 to a suitable (known) cord lock 26 and similarly the opposite end 20 extends from its grommet 24 through an adjacent similar cord lock 28. The cord locks 26 and 28 when released permit relative movement between themselves and their respective cord ends 18 and 20 so that the tightness of the cord 16 around the neck opening 12 may be adjusted and when locked prevent relative movement of their respective cord ends to hold the cord in open or closed position depending on the length of cord between the cord locks 26 and 28 i.e. with the locks released the cord ends 18 and 20 may be drawn through their respective locks 26 and 28 to tighten the cord 16 around the neck and seal the tube 14 to the neck by reducing the inside diameter of the tube 14 around the neck opening and when locked hold the cord in this sealing position or alternatively the cord ends 18 and 20 may be moved in the opposite direction to loosen the cord around the neck and the locks 26 and 28 locked to keep the cord in open not sealing position with little if any pressure being exerted to move the inside wall of the tube 14 against the neck (appendage) of the user.

The cord locks 26 and 28 preferably each has a spring locking mechanism to clamp its respective cord end 18 and 20 that is released by depressing a plunger 27 or 29 respectively while holding the remainder of the lock so that the plunger depresses into the lock and releases it cord end 18 or 20. Cord locks such as those sold under the name Toaster Eclipse Black Cord Lock Part Number 350-2000-5614 have been found to be satisfactory.

In the illustrated system each of the ends is provided at its extremity with a patch 30 and 32 respectively each of which has a surface of a hook and loop fastener adapted to cooperate with a mating hoop and loop faster secured as a patch 34 to the front 36 of the garment 10. Each of the cord locks 26 and 28 is provide with its own lanyard 38 and 40 respectively that is secured at one end to its respective cord lock 26 and 28 and at its other end to the garment 10, in the illustrated arrangement to the tube 14.

Figure 2:
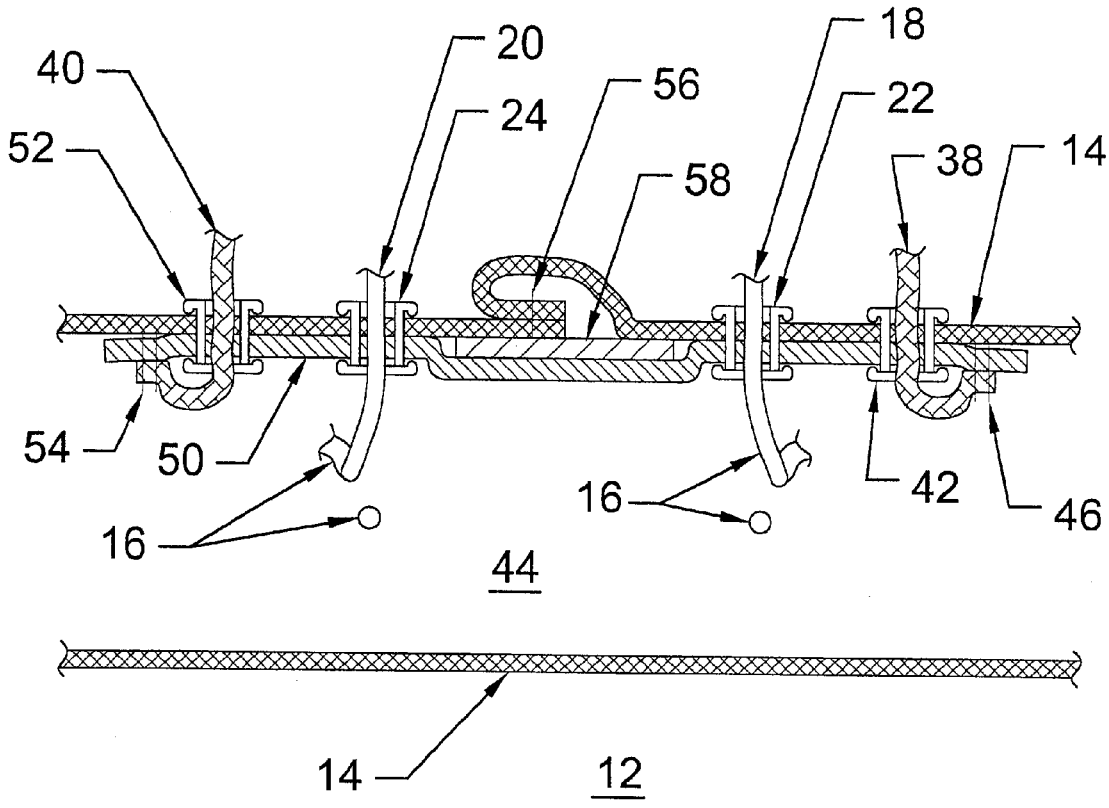
FIG. 2 is a section along the line 2—2 of FIG. 1.

As shown in FIG. 2 in the preferred arrangement the lanyard 38 passes through a grommet 42 to the inside 44 of the tube 14 and is secured as indicated at 46 to an anchor strip 50 positioned within the tube 14 adjacent to one end of the strip 50. The other lanyard 40 extends through a grommet 52 and is secured as indicated at 54 to the end of the strip 50 opposite to the end to which the lanyard 38 is secured.

It will be noted that the pairs of grommets 22 and 24 and 42 and 52 are substantially symmetrically position one of each pair on each side of a central seam formed in the outer wall of the tube 14 and through which the strip 50 is inserted into the tube 14 a short sealing tape 58 closes the opening formed at the seam 56.

The flexible tube 14 is formed from a suitable material that may be either water vapor permeable that is not permeable to liquid water or impermeable stretchable materials or a combination of both and preferably is formed from several pieces of material with the seams formed between these pieces hot melt taped to render them waterproof.

Water vapor permeability helps but it is the fact the neck line can be worn open during normal wear activities (flying, boating etc.) is the major contributor to wearer comfort. This open cuff allows ventilation of sweat-laden air from inside the suit. Conventional dry suit cuffs are always sealed around the appendage, applying a constant pressure to form a watertight seal. The present invention permits controlling the application of pressure to the appendage and restriction of ventilation only when the drawline or pull cord 16 is tensioned, which would only occur during immersion. This invention may be used with vapor permeable OR impermeable fabrics, although the preferred embodiment uses suitable vapor permeable fabrics (for comfort reasons when sealed).

Testing of the present invention indicates that the present invention may not be quite as waterproof as a conventional dry suit seal. It is believed that this is due to the fact that an inexperienced user can undertighten the seal and not form a waterproof seal. For this reason we have called the seal "water resistant" not waterproof. Full suit leakage of up to 600 g (0.6 l) has been observed after 4 hours in 30 cm high waves with the present invention, whereas conventional neck seals can exhibit 0 g ingress.

Military pilots and coast guard rescue swimmers have assisted with testing the invention. The comfort it affords them in the cockpit is has been deemed to be a favorable trade off with the minimum leakage experienced. The comfort is obtained based primarily on:

ability to turn head unrestricted allowance of ventilation and hence reduced heat strain and drier undergarments no applied pressure on neck, etc.

The "greater user comfort" is not based completely on material selection . . . it is the formation of a vent when worn loose that provides this comfort.

Having described the invention, modifications will be evident to those skilled in the art without departing from the scope of the invention as defined in the appended claims.

I claim:

1. A sealing system for sealing a garment around an appendage comprising an annular flexible tube forming part of a garment and surrounding a passage through which said appendage is intended to protrude, a cord in said tube, said cord extending within said tube for a length over more than 360° measured around said passage so that said cord more than completely encircles said passage while contained within said tube, said cord having one end and an opposite end, said cord extending out of said tube through a wall of said tube so that said one end provides an accessible end outside of said tube for adjusting the length of said cord that more than completely encircles-said passage while contained within said tube and thereby adjusting the tension in said cord to increase or reduce pressure of said tube toward said appendage around the full periphery of said passage, the amount of said pressure effecting the effectiveness of a seal formed between the tube and the appendage and securing means to secure said cord to prevent relative movement between said cord and said tube, said securing means securing said cord relative to said tube at locations spaced along the length of said cord by a distance measured along said cord greater than the circumference of said passage, said securing means including means for releasably securing said cord to prevent relative movement between said cord and said tube at at least one of said locations.

2. A sealing system for sealing a garment around an appendage as defined in claim 1 wherein said appendage is a neck of a wearer and said sealing system is a neck sealing system.

3. A sealing system for sealing a garment around an appendage as defined in claim 1 wherein said tube is made of pliable material that is permeable to water vapor but not liquid water.

4. A sealing system for sealing a garment around an appendage as defined in claim 1 wherein said means for releasably securing comprises a releasable locking means outside of said tube for engaging said cord adjacent to said accessible end for releasably preventing relative movement between said cord and said tube and a further securing means to prevent relative movement between said cord and said tube adjacent to said opposite end, said locking means and said further securing means being at said locations.

5. A sealing system for scaling a garment around an appendage as defined in claim 1 wherein means for releasably securing are provided adjacent to each of said one and said opposite ends of said cord and said opposite end extends out of said tube through said wall and said securing means further comprises another releasable locking means for engaging said cord adjacent to said opposite end for releasably preventing relative movement between said cord and said tube so that said opposite end may be adjusted relative to said tube.

6. A sealing system for sealing a garment around an appendage as defined in claim 4 wherein means for releasably securing are provide adjacent to each of said one and said opposite ends of said cord and said opposite end extends out of said tube through said wall and said securing means further comprises another releasable locking means for engaging said cord adjacent to said opposite end for releasably preventing relative movement between said cord and said tube so that said opposite end may be adjusted relative to said tube.

7. A sealing system for sealing a garment around an appendage as defined in claim 2 wherein said means for releasably securing comprises a releasable locking means outside of said tube for engaging said cord adjacent to said accessible end for releasably preventing relative movement between said cord and said tube and a further securing means to prevent relative movement between said cord and said tube adjacent to said opposite end, said locking means and said further securing means being at said locations.

8. A sealing system for sealing a garment around an appendage as defined in claim 2 wherein means for releasably securing are provided adjacent to each of said one and said opposite ends of said cord and said opposite end extends out of said tube through said wall and said securing means further comprises another releasable locking means for engaging said cord adjacent to said opposite end for releasably preventing relative movement between said cord and said tube so that said opposite end may be adjusted relative to said tube.

9. A sealing system for sealing a garment around an appendage as defined in claim 7 wherein means for releasably securing are provide adjacent to each of said one and said opposite ends of said cord and said opposite end extends out of said tube through said wall and said securing means further comprises another releasable locking means for engaging said cord adjacent to said opposite end for releasably preventing relative movement between said cord and said tube so that said opposite end may be adjusted relative to said tube.

10. A sealing system for sealing a garment around an appendage as defined in claim 3 wherein said means for releasably securing comprises a releasable locking means outside of said tube for engaging said cord adjacent to said accessible end for releasably preventing relative movement between said cord and said tube and a further securing means to prevent relative movement between said cord and said tube adjacent to said opposite end, said locking means and said further securing means being at said locations.

11. A sealing system for sealing a garment around an appendage as defined in claim 3 wherein means for releasably securing are provided adjacent to each of said one and said opposite ends of said cord and said opposite end extends out of said tube through said wall and said securing means further comprises another releasable lacking means for engaging said cord adjacent to said opposite end for releasably preventing relative movement between said cord and said tube so that said opposite end may be adjusted relative to said tube.

12. A sealing system for sealing a garment around an appendage as defined in claim 10 wherein means for releasably securing are provide adjacent to each of said one and said opposite ends of said cord and said opposite end extends out of said tube through said wall and said securing means further comprises another releasable locking means for engaging said cord adjacent to said opposite end for releasably preventing relative movement between said cord and said tube so that said opposite end maybe adjusted relative to said tube.

13. A sealing system for sealing a garment around an appendage as defined in claim 2 wherein said tube is made of pliable material that is permeable to water vapor but not liquid water.

14. A sealing system for sealing a garment around an appendage as defined in claim 1 wherein said cord extends within said tube substantially twice around said passage.

15. A sealing system for sealing a garment around an appendage as defined in claim 2 wherein said cord extends within said tube substantially twice around said passage.

16. A sealing system for sealing a garment around an appendage as defined in claim 3 wherein said cord extends within said tube substantially twice around said passage.

17. A scaling system for sealing a garment around an appendage as defined in claim 4 wherein said cord extends within said tube substantially twice around said passage.

18. A sealing system for sealing a garment around an appendage as defined in claim 5 wherein said cord extends within said tube substantially twice around said passage.

19. A sealing system for scaling a garment round art appendage as defined in claim 6 wherein said cord extends within said tube substantially twice around said passage.

20. A sealing system for sealing a garment around an appendage as defined in claim 7 wherein said cord extends within said tube substantially twice around said passage.

* * * * *